United States Patent [19]

Artiano

[11] 4,352,431

[45] Oct. 5, 1982

[54] APPARATUS FOR SORTING CONTAMINANT MATERIAL FROM PROCESSING MATERIAL

[75] Inventor: Adrian Artiano, Everett, Wash.

[73] Assignee: Black Clawson Inc., Everett, Wash.

[21] Appl. No.: 45,513

[22] Filed: Jun. 4, 1979

[51] Int. Cl.[3] ..... B07C 5/00

[52] U.S. Cl. ..... 209/600; 209/657

[58] Field of Search ..... 209/590, 657, 599, 600

[56] References Cited

U.S. PATENT DOCUMENTS

| | | | |
|---|---|---|---|
| 3,127,016 | 3/1964 | Baigent | 209/590 |
| 3,394,806 | 7/1968 | Vaillette | 209/590 |
| 4,147,620 | 4/1979 | Artiano | 209/590 |

FOREIGN PATENT DOCUMENTS

| | | | |
|---|---|---|---|
| 1125740 | 3/1962 | Fed. Rep. of Germany | 209/590 |

*Primary Examiner*—Allen N. Knowles

*Attorney, Agent, or Firm*—Biebel, French & Nauman

[57] ABSTRACT

A contaminant sorting device for sorting contaminant material, such as metal and rocks, from processing materials, such as wood chips, comprising a housing having internal walls formed of a surface of revolution into which housing is fed processing material at the upper portion thereof, an impeller disposed in the housing for receiving processing material and propelling it radially outwardly against the inner surfaces of the housing walls, a plurality of vibration sensing devices disposed around the walls of the housing for sensing vibrations due to impingement of the processing material on the walls, an electrical circuit for distinguishing between signals generated in response to impact of the processing material from response to impact of contaminant material, a series of trap doors each associated with a corresponding vibration sensing device and disposed downstream in the material flow path for diverting from the normal flow path a portion of processing material containing contaminant material.

15 Claims, 7 Drawing Figures

APPARATUS FOR SORTING CONTAMINANT MATERIAL FROM PROCESSING MATERIAL

BACKGROUND OF THE INVENTION

1. Field of the Invention

The present invention relates to contaminant sorting devices and, more particularly, to a method and apparatus for sorting contaminant material such as metal and rocks from processing material such as wood chips and the like.

2. Prior Art

In the wood processing industry as well as in many other similar industries, the material being processed, such as wood chips, is often contaminated by material which cannot be processed, such as tramp metal or rocks. Referring specifically to the wood processing industry to which the present invention is more particularly related, it is necessary to remove this contaminant material at an early stage of the processing so as to prevent damage to machinery or production of a materially poor product.

In the wood processing industry there are many processes which involve the reduction of wood particle size by the use of equipment such as chippers, rechippers, flakers and the like, which use, for example, knives or anvils for reducing particle size of the wood chips. If relatively hard material, such as rocks or tramp metal, is introduced into these devices it can cause severe damage to the equipment and result in substantial processing delay due to the necessity of removing the contaminant material and possibly replacing parts in the devices.

Several means are currently used for removing metal objects from the wood material being processed, which generally incorporate magnetic sensing devices which locate metallic objects. However, such devices are ineffective for detecting rocks and similar other nonferrometallic hard objects which can cause as severe damage as the ferro-metallic objects. In the past, it has been necessary to make visual inspection of the material being processed in order to remove such contaminant, making the process more expensive and susceptible of human error which often results in damage to the processing equipment due to failure to spot the contaminant material.

More recently, equipment has been developed which is capable of accurately sensing the existence of nonferro-metallic objects, such as rocks, and provides for automatic removal of that portion of the material being processed which includes the contaminant. Such a device is disclosed, for example, in U.S. Pat. No. 4,147,620. This device provides an inclined, flat surface on which the processing material is dropped and which acts as a sounding board for a transducer attached to the back of the surface. The vibration produced by impact of a contaminant object is different from that of the vibration produced by wood chips, which difference is discernable by the sensing device. The sensing device activates a trap door as that portion of processing material containing the contaminant slides down the inclined surface and is then diverted from the main flow of processing material. After the contaminant material has been diverted and the trap door closes, the subsequent processing material will pass along its normal flow path to be collected for use in subsequent processing.

SUMMARY OF THE INVENTION

The present invention is an improvement over the apparatus disclosed in the above referred to patent and provides certain advantages over such devices.

The present invention uses a material receiving surface, or sounding board, in the form of a surface of revolution rather than a planar, inclined surface. The surface of revolution is formed about a vertical axis and is contained in a housing which has a material receiving opening in the upper portion thereof. An impeller is concentrically mounted with the vertical axis of the surface of revolution, for rotation so as to propel the processing material which is deposited thereon, in such a manner that it impacts the surface of revolution.

Although the impeller may be in the form of a flat disc, it is preferable that it be provided with some contour on its upper surface which engages the material being deposited thereon and assists in increasing the vertical spread of the processing material so that the material will not impact the surface of revolution along a common horizontal plane. In other words, the impeller should preferably be provided with some means for spreading out the pattern of impact of the processing material as it leaves the impeller and strikes the surface of revolution.

This can be accomplished, for example, by placing a series of equally angularly spaced triangular cross sectioned rods on the surface of the disc forming the impeller, so that they will provide a vertical component to the trajectory of at least some of the material being processed and thus cause that material to impact the surface of revolution above the horizontal plane containing the disc of the impeller. A further variation of impeller can be provided with a fan-like blade arrangement which permits material deposited thereon to be spread vertically both upward and downward so as to further increase the spread of impact of material on the surface of revolution as it comes from the impeller.

The surface of revolution is preferably inclined relative to the vertical so that the material will be guided or permitted to drop into the lower portion of the housing. A plurality of vibration sensing devices, such a transducers, are mounted at circumferentially spaced locations on the back side of the inner walls forming the surface of revolution, for monitoring the vibrations of the surface caused by impingement of feed material thereon in the area surrounding each transducer, as the feed material is propelled from the impeller.

Downstream in the flow path of the material within the housing are located a plurality of trap doors, one of each of which is associated with a corresponding sensing device located immediately upstream of the trap door. Each sensing device controls movement of the corresponding trap door so that it can be moved into the flow path of the processing material after it has impacted the surface so as to divert that portion of processing material which has just impacted the surface.

Each sensing device is associated with circuitry for analizing the characteristics of the vibration of the inner wall due to impact of processing material thereon and is further capable of distinguishing between the vibrations caused due to impact of the processing material, such as wood chips or the like, and contaminant material, such as metal or rocks. Upon determination by the sensing circuitry that contaminant material has impacted the surface, the trap door associated with the particular sensing device is activated to move into the flow path of the processing material and divert that portion of the processing material which contains the contaminant.

After a predetermined period of timee which is sufficient to permit the contaminant material to be removed from the normal flow path, the trap door is closed which then permits the processing material to return to its normal flow path. Thus, each of the sensing devices operates independently to activate its associated trap door so that as contaminant material impacts the surface of revolution at a particular location only the material in the immediate vicinity of that contaminant is diverted from the normal flow path and the remaining material is permitted to continue along the normal flow path and into the bottom of the housing where a discharge opening is provided and means for collecting that uncontaminanted processing material is disposed.

Referring again to the vibration sensing device, the signal sent from the transducer is analyzed in a signal discriminating circuit which basically distinguishes in the amplitude of the signal received from the transducer by impingement of wood chips or the like from that received when rocks or metal objects or other relatively hard material impacts the inner wall. Wood chips, particularly wet chips which have been recently cut, cause substantially less amplitude and duration of vibration of the surface than do metal objects or rocks. There is therefore a fairly well defined line of demarcation between the amplitudes of vibration caused by these materials, which can be discerned by the electronic circuit used in the present invention.

Signals from the transducer produced by impact of wood chips on the sounding board are initially filtered out and only those signals having an amplitude of at least a predetermined threshold value will be permitted to pass further into the circuit. Signals produced by impact of rocks or metal not only have a higher amplitude, but also are more prolonged than signals produced by impact of wood chips. Although it is possible for wood chips to produce some signals of sufficient amplitude to pass through the initial filtering portion of the circuit, they do not produce the sustained series of signals to be comparable in this regard to the signals produced by rocks or metal. Therefore, another portion of the circuit is designed to monitor the number of repetitions of signals having sufficient amplitude so that an output signal is only produced from that portion of the discriminating circuit if a sustained level of amplitude is reached.

Once the circuit senses the sustained level of sufficient amplitude the output signal from the discriminating circuit activates the trap door mechanism so as to divert the portion of material flow containing the contaminant material from the normal flow path of the material.

The trap means is preferably a portion of a surface of revolution contoured to correspond to the lower edge of the sounding surface, with the plurality of trap doors forming a continuous surface of revolution when closed, such as a cone. Each trap door is hinged at its lower end so that it can be pivoted inwardly into the normal flow path of the process material being sorted. Each trap door is pivoted by means of a double acting hydraulic or pneumatic cylinder positioned out of the flow path and which rotates the trap door in response to a signal from the signal descriminating means indicating that contaminant material has impacted the material receiving surface.

Due to the time delay between impact of the contaminant material on the material receiving surface and the time it reaches the trap means, it is also preferable to include a time delay device which is designed to delay the time of activation of the trap door until the contaminant material has reached the lower edge of the material receiving surface so that it is adjacent the trap door. Also, a time delay device is provided to hold the trap door open for sufficient time to permit the contaminant material to be removed from the flow path.

DETAILED DESCRIPTION OF THE PREFERRED EMBODIMENT

Figure 1:
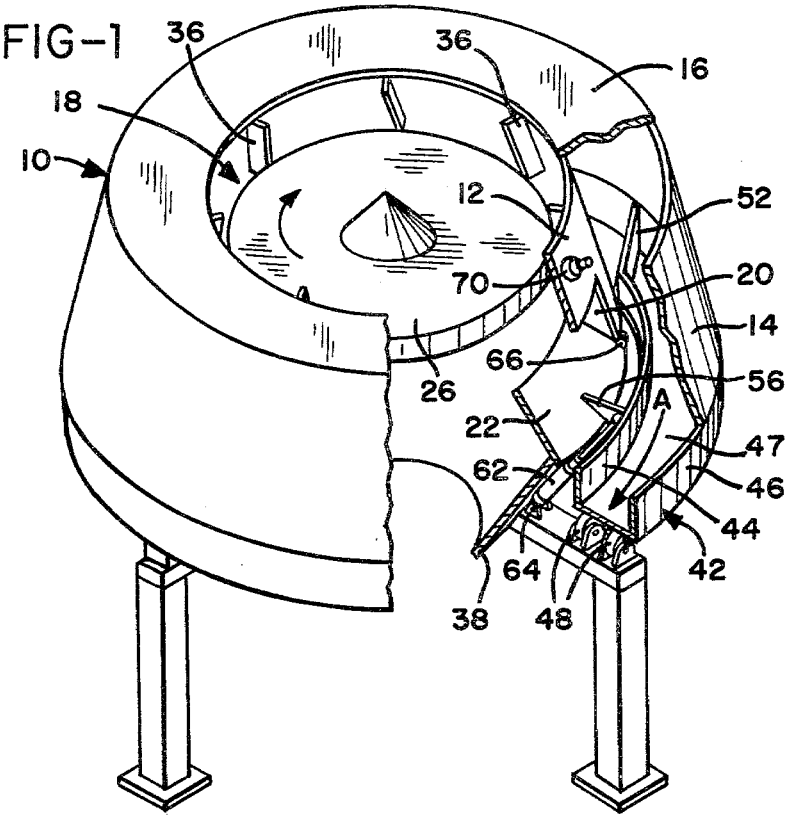
FIG. 1 is a pictorial illustration of the preferred embodiment of the present invention with a portion broken away to illustrate the internal construction.

The preferred embodiment of the contaminant material sorting apparatus of the present invention has an external housing 10 in the form of a surface of revolution which, in the preferred form, is frusto-conically shaped with inner and outer walls 12 and 14, respectively, and an upper wall 16 with a circular opening 18 defined therein which forms the feed receiving means through which processing material can be fed. Processing material for which the preferred embodiment is designed would generally be in the form of wood chips and the like, such as those that have come from a conventional chipping apparatus and are being further processed in a paper making process. For example, it is common to have such chips approximately 1¼ inch long and 3/16 inch thick as they are received from the chipper (not shown) and sent by conveyors (not shown) to the contaminant sorting device and are dumped into the feed receiving opening 18.

Referring again to the housing 10, the internal wall 12 is also a surface of revolution and is actually the only surface within the housing which need be a surface of revolution since it is the only operative surface in the housing. In the preferred form, the inner wall 12 is frusto-conically shaped extending downwardly and outwardly from the inner edge of the wall 16 forming the feed receiving opening 18. Although the inner wall 12 is described as a single, one-piece wall, this need not be the case. In fact, it may be desirable to use a plurality of individual pieces fitted together in generally abutting relation to form internal wall 12, with vibration insulation material between adjacent pieces to reduce the possibility of "cross talk" between adjacent vibration sensing devices.

A plurality of rectangular openings 20 are defined in the inner wall 12 around the lower edge portion thereof and circumferentially equally spaced locations around the entire inner wall. Each of these openings 20 has a corresponding shaped trap door 22 which, when in position with registry with the opening 20, form a smooth side wall along with the internal surface of inner wall 12. The trap doors 22 are each individually, pivotally mounted to rotate their upper edge portions inwardly, as illustrated in FIG. 1, and is described in more detail below.

There is shown a portion 24 of the inner wall 12 extending between adjacent trap doors 22. This portion 24 should be relatively narrow in order to reduce the amount of surface area around the circumference of the inner wall which is not provided with a trap door, since any contaminant material which would strike this area could not be eliminated from the main flow of processing material. In fact, in some constructions it would be possible to completely eliminate this small fixed portion 24 of the inner wall 12 and present a total surface of trap doors 22 which abut each other.

Disposed in the housing 10 concentrically with the axis for the surface of revolution of the inner wall 12 and mounted for rotation is a disc-shaped impeller 26. Impeller 26, along with the drive motor 28 and gear reduction unit 30, are supported centrally in the housing 10 by a pair of support brackets 32 and 34 which are secured to the gear reduction unit 30 and bolted or otherwise secured to the inner wall 12 in order to rigidly support the impeller 26 in position. The diameter of impeller 26 is somewhat reduced from the diameter of the inner wall 12 in the same plane in order to permit passage of the processing material between the outer periphery of the disc-shaped impeller 26 and the adjacent inner surface of wall 12.

Although a flat disc may be utilized for the impeller 26, it is preferable to provide some contour on the surface thereof in order to enhance the distribution characteristics of the impeller in the vertical direction. If the impeller 26 consists of a flat disc, the material which is deposited thereon will be spun or propelled outwardly toward the inner wall 12 in essentially a horizontal plane and thus impact the inner wall 12 along a fairly narrow area around the entire surface. This may cause failure of the apparatus to detect contaminant material in those instances where wood chips or the like impact the inner wall 12, and act as a cushion for subsequently propelled contaminant material which then would not directly impact the surface and would not be sensed by the sensing equipment described below.

This possible deficiency can be reduced by providing means on the surface of the impeller 26 for spreading the material vertically as it leaves the impeller and thus cause it to impact the inner wall 12 over a broader surface area than would be the case with a flat disc. Two examples of preferred embodiments for causing this increase in spread are illustrated in FIGS. 6 and 7.

Figure 6:
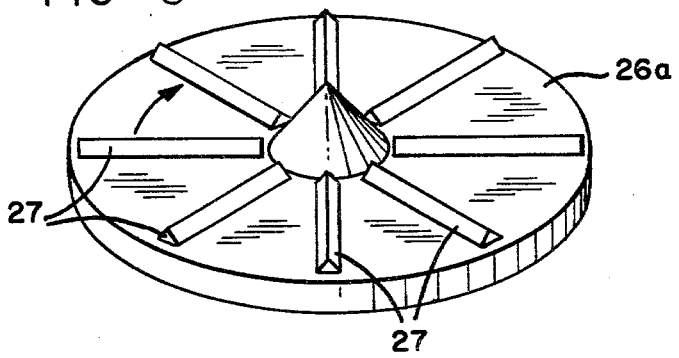
FIG. 6 is a pictorial view of a first preferred embodiment of the impeller means of the present invention.

Referring first to the modified impeller disc **26*a*, as illustrated in FIG. 6, it is provided with a plurality of equally angularly spaced triangular cross section bars 27 which can be welded or otherwise secured to the upper surface of the flat disc forming the main body of the impeller. These bars 27 will cause some of the processing material deposited upon the impeller 26*a* to be deflected upwardly away from the surface of the impeller and thus to impact the inner wall 12 at an upwardly vertically spaced relation from the horizontal plane of the disc of the impeller and thus, since different pieces of the processing material will be propelled to different heights the material will be forced to spread out and impact a larger area along the inner surface of inner wall 12**.

Figure 7:
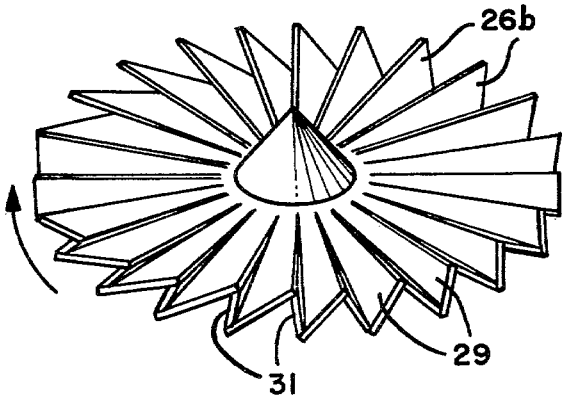
FIG. 7 is a pictorial view of a second preferred embodiment of the impeller means of the present invention.

A further preferred embodiment of impeller means **26*b* is illustrated in FIG. 7. In this embodiment a plurality of fan-like blades 29 extend outwardly from the central hub portion to which they are secured and are disposed at an angle away from the vertical plane in the direction of rotation of the impeller 26*b*. In addition, a filler plate 31 is welded or otherwise secured between adjacent edge portions of adjacent blades 29 to fill the gaps which would otherwise exist if the fan-like blades 29 were used alone. This prevents material from merely falling through the impeller and possibly contaminating the output material from the apparatus. As impeller 26*b* is rotated in the direction of the arrow and the material is deposited thereon, it will cause a vertical spread of the material both above and below the plane containing the upper edges of the blades 29 since the blades extend downwardly as well, and thus cause a greater vertical spread of the processing material both above and below the impeller 26*b*. This further increases the spread of the material as it impacts the inner wall 12** of the device and thus decreases the possible cushioning of contaminant material by the softer material which might impact the inner wall ahead of it.

Disposed in the space between the outer periphery of disc-shaped impeller 26 and the inner surface of inner wall 12 are a plurality of equally, circumferentially spaced deflector plates 36. Each deflector plate is slanted from the vertical downwardly in the direction of rotation of impeller 26. These deflector plates 36 serve to deflect the processing material downwardly along the inner surface of wall 12 as it is thrown off of the impeller and impacts the inner surface of the side walls 12.

The rotational speed of impeller 26 will, to some extent, depend upon the material being processed. This is because the rotational velocity necessary to propel the processing material into the wall at sufficient velocity to permit the sensing devices to make a distinguishing determination between the quality of vibration due to impact due to processing material and that due to contaminant material, will vary for various densities of processing material. The appropriate velocity of rotation for a given processing material can easily be determined through experimentation at various rotational speeds until the device operates satisfactorily.

Disposed immediately beneath the series of trap doors 22 within the normal flow path of processing material is a discharge means 38 in the form of an inverted frusto-conical member which has its upper edge portion immediately abutting the lower edge portions of each of the trap doors 22 and the inter-spaced portions 24 of inner wall 12. The discharge means 38 directs the flow path of acceptable processing material centrally towards the opening 40 through which it is discharged and accumulated for further use.

Also positioned immediately adjacent the lower edge portions of the trap doors 22, but externally thereof in the diverted flow path of that portion of processing material which contains contaminant, is a contaminant material collecting trough 42. This trough is in the form of a U-shaped cross section channel member which is cylindrical and has its inner wall 44 positioned immediately adjacent and below the bottom edge of trap door 22 so as to be inside the flow path of the contaminant material which is deflected into the trough over this inner wall 44. The outer wall 46 of trough 42 has its upper edge portion abutting the lower edge portion of outer wall 14 of housing 10 in order to prevent contaminant material from falling out of the trough.

Figure 2:
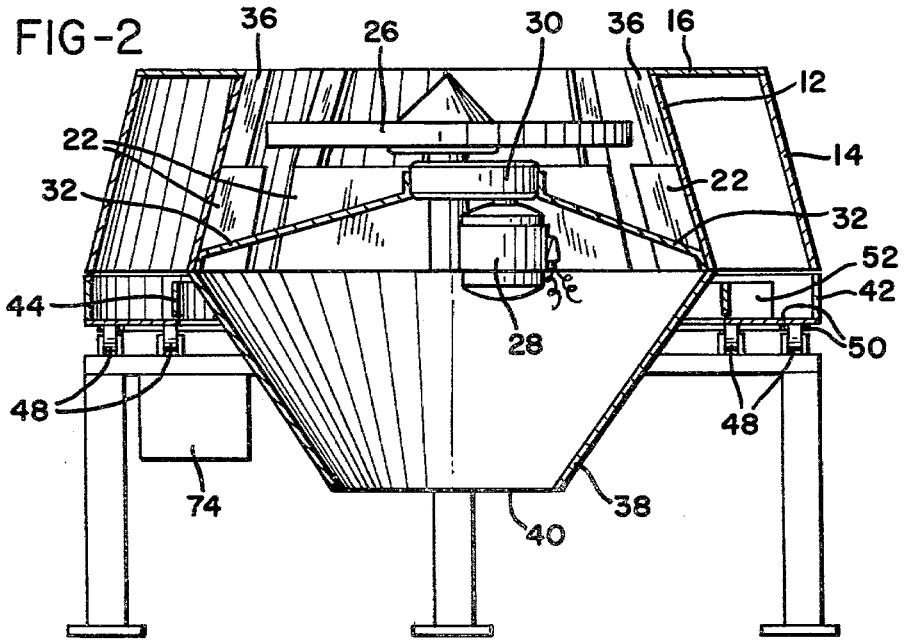
FIG. 2 is a vertical cross sectional along line 2—2 of FIG. 3.
Figure 3:
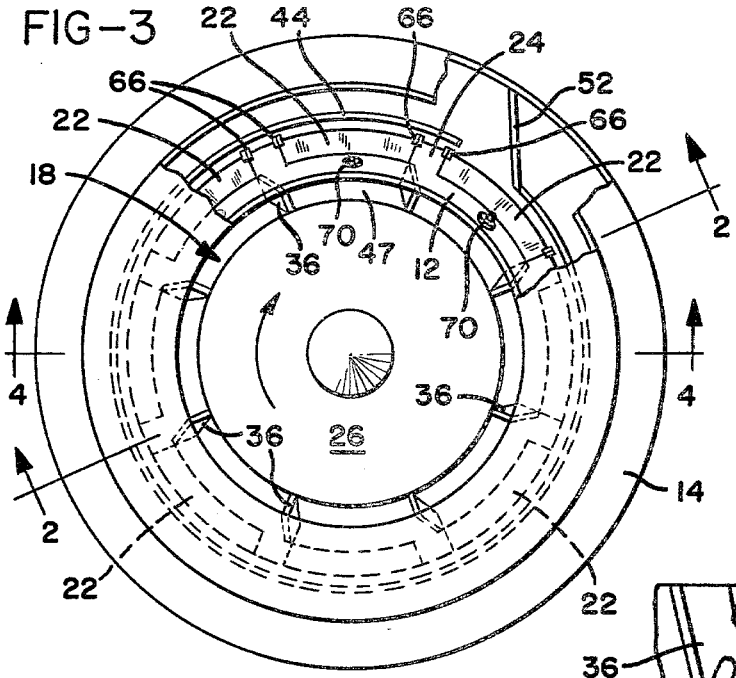
FIG. 3 is a top plan view of the embodiment of FIG. 1 partially broken away to show details of the internal construction.

The inner wall 44 of trough 42 is not attached to the remainder of the trough, but instead is secured to the lower edge portion of inner wall 12 and is fixed relative to the trap doors 22. The outer wall 46 and the bottom plate 47 are secured together for rotation and are supported by a plurality of rollers 48 which are mounted for rotation on the frame of the apparatus and contact the bottom surface of bottom plate 47. In order to maintain outer wall 46 and bottom plate 47 concentrically aligned with housing 10 during rotation, a pair of circular guide rails 50 are formed on the lower surface of bottom plate 47 on each side of at least one set of rollers 48 as shown in FIG. 2.

Secured to the inner wall 44 or formed as a bent portion thereof is a contaminant discharge blade 52 which has its lower edge portion riding on the upper surface of the bottom plate 47 and its outer vertical edge portion is disposed immediately adjacent the inner surface of outer wall 46 so that it will scrape the contaminant from the entire cross section of the trough 42. A discharge opening 54 is formed in the inner wall 44 immediately adjacent blade 52, through which the contaminant will be discharged when the trough 42 is rotated in the direction of arrow A. Rotation of trough 42 can be accomplished manually or by use of drive motor (not shown) after an accumulation of contaminant material in the trough 42 or the trough may be constantly rotated if this is desired. The contaminant material which is discharged through opening 54 can then be collected separately from the processed material which is discharged through opening 40.

Referring now to the mounting for trap doors 22, each door has a triangular bracket 56 welded to the back side thereof with a hole in the outer lower corner thereof through which can be inserted a pin 58 for pivotally securing the rod 60 connected to a piston in a double acting hydraulic or pneumatic cylinder 62. The opposite end of cylinder 62 is pivotally mounted to an end portion of a second triangular bracket 64 welded to the outer wall of the discharge means 38. At the lower edge portion of each trap door 22 at the outer most extremity thereof, the trap doors are pivotally connected by pins through hinge type formations 66 to the adjacent upper edge portion of the discharge means 38. Thus, upon activation of hydraulic cylinder 62 so that the piston rod 60 is extended the trap door 22 will be pivoted inwardly about pins 66 into the path of the processing material, as illustrated in FIG. 1. Upon retraction of the rod 60 into the hydraulic cylinder 62 the trap door 22 will be moved to its inoperative position, as illustrated in FIG. 2.

In order to operate each of the trap doors 22 at the proper time an electrical control circuit for each is provided which is activated by a respective transducer 70 secured to the back side of inner wall 12 upstream in the normal flow path of processing material from the respective trap door 22. A separate circuit, is associated with each of these transducers so as to separately operate the respective cylinders 62 associated with each trap door 22. A single transducer and control circuit for a single trap door will be described below and it is to be understood that the circuit is the same for each trap door around the periphery of the apparatus.

The transducer 70 is preferably a piezoelectric transducer of sufficiently high natural frequency, e.g. 20–40 kHz, to pick up the vibrations in the inner wall due to impingement of the material thereof. The transducer is connected to the control circuit mounted in box 74 on the bottom of the frame of the apparatus.

More specifically, the transducer input from transducer 70 is received by a circuit. This input which is capacitor coupled to the remainder of the circuit since the AC component is the only portion of the signal from the transducer which is utilized in the circuit. The input voltage through the capacitor referred to above provides an input voltage signal to a first stage amplifier which provides an initial amplification of the signal. This first stage amplifier is coupled in parallel with a capacitor in order to prevent oscillation of the circuit. The first stage amplifier is coupled to a second stage amplififer through resistors and a capacitor which coupling provides a means of adjustment of attenuation for the second stage amplifier.

This second stage amplifier is provided with a tuned circuit which permits the second amplifier to be tuned to the natural frequency of the transducer 70. This portion of the circuit acts as a band pass filter which produces a signal output only at around the natural frequency of the transducer.

The second amplifier provides an amplified output voltage to a signal limiter which limits the amplitude of the sinusoidal wave from the second amplifier to produce a square wave signal. The signal limiter is in turn coupled to a pulse train detector and integrator circuit which together require a predetermined number of pulses to be received from the signal limiter before producing an output signal to a driver amplifier. Resistors provide control over the number of pulses required in order to produce an output signal from the pulse train detector and integrator circuit.

Certain portions of the above described circuit namely, the first and second amplifiers, the signal limiter, pulse train detector, integrator and the driver amplifier can be provided by an integrated circuit such as is commercially available from National Semiconductor Corp., Santa Clara, Calif., and designated by part number LM1812.

Referring again to the circuit the driver amplifier upon receipt of a signal from the integrated circuit referred to, in turn produces a signal to trigger a pair of timers. The first timer is a timer which can be provided by an integrated circuit such as an NE555 available from Signetics Corp., Sunnyvale, Calif., which in connection with a resistor and a capacitor to provide an adjustable signal output of the desired duration. This signal output can optionally be utilized to inhibit further signal output from the integrated circuit referred to during activation of the trap door 22 in order to prevent the circuit from being retriggered while it is already operating which could otherwise cause jamming of the door.

The signal from the driver output of the integrated circuit is also provided to a second timer which can be an integrated circuit such as an NE555 which also provides a time delay that can be varied in duration by adjusting associated resistance. This second timer is used to delay opening of trap door 22 for a sufficient period of time to permit the contaminant material to pass from the point of impact on the surface of inner wall 12 to a position immediately upstream of the trap door before the trap door is opened so that an unnecessary amount of uncontaminated material is not lost by the trap door being prematurely opened.

This second timer is coupled through a capacitor to another timer which is also a time delay mechanism such as an integrated circuit NE555 that can also be adjusted for the desired time delay by associated resistances. This other timer is intended to provide the output signal which activates a solenoid valve to provide fluid to cylinder 62 that operate the trap door 22. This other timer also maintains the trap door open for the desired period of time. After the period of time has elapsed the solenoid valve is released and the trap door 22 is closed by the double acting cylinder 62.

The power inputs to the timers referred to above as well as the output from the driver amplifier are all maintained at a positive voltage level which is supplied by a power supply (not shown).

This voltage supply normally maintains a positive potential output for the driver amplifier and a positive potential input on the timers. Since NE555 integrated circuits are trailing edge activated, i.e. they will be activated by a negative going pulse or by the decrease in positive voltage, the signal generated by the driver amplifier is a negative going pulse of short duration. The trailing edge of this pulse triggers the first and second timers simultaneously which results in a positive output from them. The decreasing voltage then produced by turning off the second timer after the predetermined time will activate the other timer which in turn operates the solenoid valve, as mentioned above.

Figure 5:
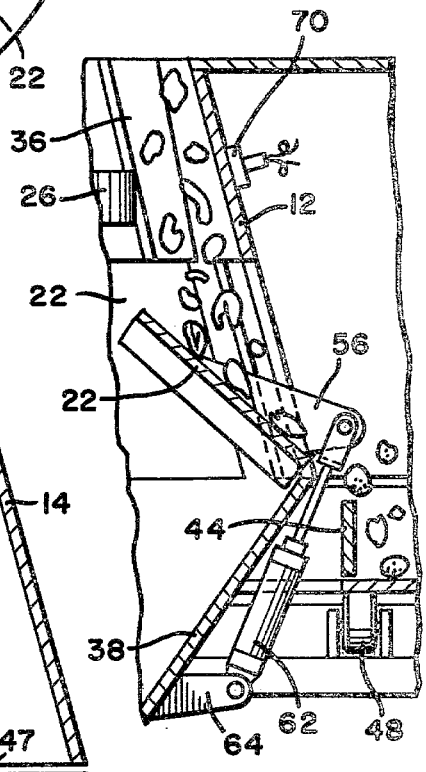
FIG. 5 is an expanded cross sectional view similar to FIG. 4, illustrating the flow path of the material with the trap door means in the operative position to divert contaminant material from the regular flow path.
Figure 4:
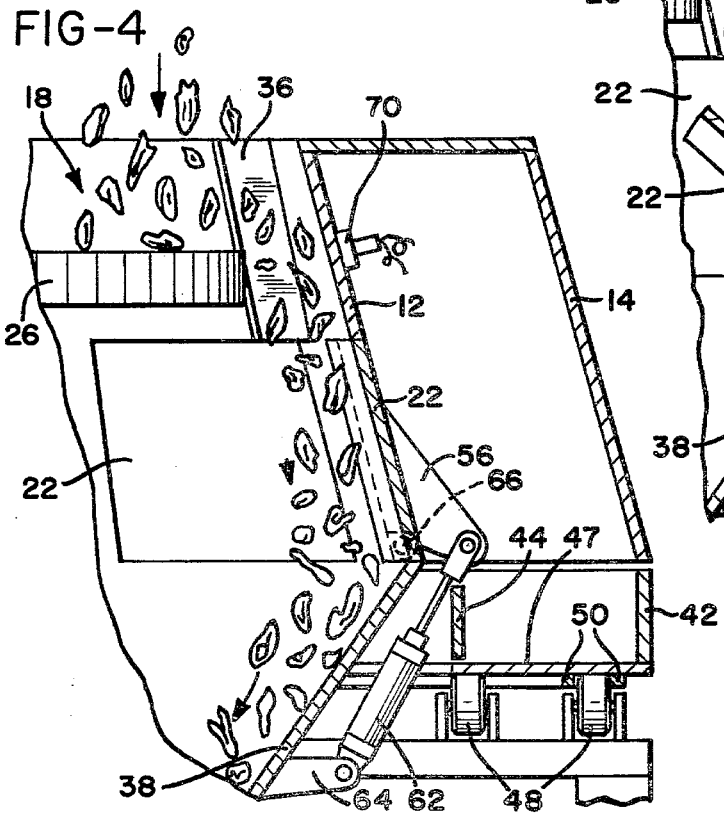
FIG. 4 is an expanded cross sectional view of the upper quarter portion of the preferred embodiment along line 4—4 of FIG. 3, illustrating the flow path of material with the trap door means in the inoperative position and showing the operative position in phantom.

Thus, it can be seen that in operation of the device, when process material to be sorted is delivered into the opening 18 and is deposited on the impeller 26, it will then be propelled outwardly against the inner surface of inner wall 12 and deflected downwardly due to the slant of the inner surface as well as the deflectors 36 and will then flow downwardly due to gravity until it impacts the surface of the discharge means 38 where it will be directed to the discharge opening 40. If contaminant material is propelled against the inner surface of inner wall 12 adjacent one of the transducers 70, the control circuit will activate the associated trap door 22 and deflect the layer of contaminant material is illustrated in FIG. 5 so that the material will flow into trough 42 from which it can be collected. After a period of time sufficient to prevent the contaminant material to be diverted by the trap door, the control circuit will cause the trap door to be closed and permit the material to flow along its normal flow path as illustrated in FIG. 4. It is to be noted that when a piece of metal or rock impacts the inner surface of inner wall 12 a signal at substantially greater amplitude is produced as well as a series of such signals of greater duration, then is produced by impact of wood chips on this inner surface. These signals of higher amplitude operate the control circuit as described above in order to activate the trap doors through the double acting cylinders 62.

Although the foregoing illustrates the preferred embodiment of the present invention, other variations are possible. All such variations as would be considered obvious to one skilled in this art are intended to be included within the scope of the invention as defined by the following claims.

What is claimed is:

1. An apparatus for sorting contaminant material, such as rocks and metal, from processing material, such as wood chips, comprising:

a housing having an internal wall formed of a surface of revolution along a central vertical axis;

feed means defined in the upper portion of said housing for receiving said processing material;

discharge means in the lower portion of said housing for discharging said processing material;

impeller means disposed in said housing for receiving said processing material from said feed means and for propelling said processing material radially outwardly against said internal wall of said housing;

means for sensing vibrations of said internal wall due to impingement of said processing material thereon and for generating signals in response thereto;

means for distinguishing between signals generated in response to impact of said processing material from signals generated in response to impact of said contaminant material;

material flow diverting means disposed vertically beneath said internal wall of said housing downstream in the movement of the normal flow path of said processing material and movable between an inoperative position in which said processing material flows along its normal flow path past said material flow diverting means to an operative position for diverting from said normal flow path a portion of said processing material containing said contaminant material; and means for receiving said signal from said signal distinguishing means and for activating said material flow diverting means to move from said inoperative position to said operative position in response thereto and for further causing said flow diverting means to move from said operative position to said inoperative position after a sufficient time to permit said portion of said processing material containing said contaminant material to be diverted.

2. Apparatus as defined in claim 1 wherein said means for distinguishing between signals includes means for distinguishing between the amplitudes and durations of vibration of said internal wall caused respectively by said processing material and said contaminant material.

3. Apparatus as defined in claim 1 wherein said internal wall is conically shaped sloping downwardly and outwardly from said feed means and said material flow diverting means are in the form of a plurality of trap door means disposed downstream from said internal wall in the normal flow path of said processing material and which are moved inwardly toward the vertical axis of said housing in order to divert the flow path of said portion of said processing material and are moved outwardly to a position removed from the normal flow path of material when deactivated.

4. Apparatus as defined in claim 1 including means disposed in the flow path of said portion of processing material containing such contaminant material which is diverted by said material flow diverting means, for accumulating said portion of said processing material.

5. An apparatus as defined in claim 1 wherein said impeller means is a flat disc which is rotated so as to propel said processing material radially outwardly against said internal wall.

6. Apparatus as defined in claim 5 wherein said impeller means further includes a plurality of equally angularly spaced and radially extending ridges on the upper surface of said flat disc.

7. Apparatus as defined in claim 6 wherein said ridges are formed by radially extending bars secured to said flat disc.

8. Apparatus as defined in claim 1 wherein said impeller means includes a plurality of fan-like blades disposed in equally spaced relation about the periphery of said impeller means and having filler plates connecting adjacent edge portions of said fan-like blades.

9. Apparatus as defined in claim 1 including a plurality of flow deflection means disposed at intervals along said internal wall of said housing for interrupting tangential movement of the processing material as it is propelled from said impeller means and for diverting the flow of said processing material downwardly along said internal wall.

10. Apparatus as defined in claim 3 wherein said trap door means are in the form of a plurality of circumferentially spaced doors individually pivotally mounted at their lower end portions for movement of their upper end portions inwardly towards the vertical axis of said housing for diverting the portion of said processing material containing said contaminant material and rotatable to a position out of the normal flow path of said processing material.

11. Apparatus as defined in claim 10 wherein separate means for sensing vibrations are associated with each said trap door for independent operation thereof, said sensing means being disposed for sensing vibration of a portion of the internal wall of said housing immediately above its associated trap door.

12. Apparatus as defined in claim 1 wherein said sensing means includes a transducer means for sensing of vibrations of said internal wall due to impingement of said processing material thereon and for sending continuous signals to said signal distinguishing means, said transducer means being sufficiently sensitive to produce different amplitude signal outputs in response to differences in amplitude of vibration of said internal wall due to impingement of said contaminant material or impingement of said processing material thereon.

13. Apparatus as defined in claim 12 wherein said signal distinguishing means includes:

means for preventing passage of signals below a predetermined threshold amplitude and for passing those above said threshold amplitude;

means for sensing the output signals from said passage preventing means and for providing an output signal upon sensing of both;

(a) a further predetermined amplitude of signals and (b) a predetermined duration of a plurality of said further predetermined amplitude of signals.

14. Apparatus as defined in claim 13 wherein said activating means includes:

first time delay means for delaying initiation of movement of said material flow diverting means from said inoperative position to said operative position for a time sufficient to permit said contaminant material to move from where it impinges on said internal wall of said housing to a position immediately upstream of said material flow diverting means; and second time delay means for maintaining said trap means in said operative position for sufficient time to permit said contaminant material to be diverted from said normal flow path.

15. Apparatus as defined in claim 14 including means for preventing a signal output from said distinguishing means to said activating means while said trap means is in said operative position.

* * * * *